US012601353B1

(12) United States Patent
Liu et al.

(10) Patent No.: US 12,601,353 B1
(45) Date of Patent: Apr. 14, 2026

(54) PORTABLE FAN

(71) Applicant: SHENZHEN JISU TECHNOLOGY CO., LTD, Shenzhen (CN)

(72) Inventors: Zhijun Liu, Shenzhen (CN); Zichen Luo, Shenzhen (CN)

(73) Assignee: SHENZHEN JISU TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/234,724

(22) Filed: Jun. 11, 2025

(51) Int. Cl.
*F04D 25/06* (2006.01)
*F04D 17/06* (2006.01)
*F04D 25/08* (2006.01)

(52) U.S. Cl.
CPC ..... *F04D 25/0613* (2013.01); *F04D 17/06* (2013.01); *F04D 25/0673* (2013.01); *F04D 25/084* (2013.01); *F04D 25/08* (2013.01)

(58) Field of Classification Search
CPC .... F04D 17/06; F04D 19/002; F04D 25/0613; F04D 25/0673; F04D 25/0693; F04D 25/084; F04D 29/2255; F04D 29/4253; F04D 29/547; F04D 25/08
See application file for complete search history.

(56) References Cited

U.S. PATENT DOCUMENTS 10,330,120 B2 * 6/2019 Yang ..... F04D 29/4253
11,566,628 B1 * 1/2023 Liu ..... F04D 19/002
D1,057,931 S 1/2025 Liu et al.
2010/0215527 A1 * 8/2010 Suzuki ..... F04D 25/0613 417/423.14
2010/0290923 A1 * 11/2010 Liu ..... F04D 27/004 417/423.1
2015/0023779 A1 * 1/2015 Li ..... F04D 29/646 415/208.1
2017/0045246 A1 * 2/2017 Kaleta ..... F24F 7/007
2019/0113218 A1 * 4/2019 Wiegel ..... F21V 23/04
2019/0154042 A1 * 5/2019 Chang ..... F04D 19/002
2020/0332810 A1 * 10/2020 Liu ..... F04D 19/007
(Continued)

FOREIGN PATENT DOCUMENTS

CN 109139504 A * 1/2019 ..... F04D 29/703
CN 112879337 A 6/2021
CN 215409301 U * 1/2022 ..... F04D 25/0673
(Continued)

*Primary Examiner* — Charles G Freay
*Assistant Examiner* — Joseph S. Herrmann
(74) *Attorney, Agent, or Firm* — HOWARD M COFIN and Associates, LLC

(57) ABSTRACT

A schematic diagram of a portable fan of the present disclosure is shown. The portable fan includes a housing, a substrate, and a fan assembly. The housing includes an accommodating cavity. The housing is further formed with an air inlet communicated to the accommodating cavity. At least a portion of the substrate is arranged on a radial inner side of the housing, and an air outlet is formed between the substrate and the housing. The fan assembly is arranged inside the accommodating cavity and is connected to a rear side of the substrate. The fan assembly includes a motor and a fan blade. The motor is a high-speed motor. A maximum diameter of the substrate is greater than or equal to a maximum diameter of the fan assembly, a front side of the substrate includes a protrusion. The protrusion protrudes forwards out of a front end of the housing.

18 Claims, 5 Drawing Sheets

(56) References Cited

U.S. PATENT DOCUMENTS

| | | | | |
|---|---|---|---|---|
| 2021/0355953 | A1* | 11/2021 | Chen | F04D 25/062 |
| 2024/0401604 | A1* | 12/2024 | Lin | F04D 19/002 |

FOREIGN PATENT DOCUMENTS

| | | | | | |
|---|---|---|---|---|---|
| CN | 216157930 | U | * | 4/2022 | |
| CN | 217029355 | U | * | 7/2022 | F04D 25/0693 |
| CN | 219388207 | U | * | 7/2023 | |
| CN | 308990629 | S | | 12/2024 | |
| CN | 308990630 | S | | 12/2024 | |
| WO | WO-2021123709 | A1 | * | 6/2021 | F04D 25/0613 |

* cited by examiner

PORTABLE FAN

TECHNICAL FIELD

The present disclosure relates to the technical field of fans, and in particular, to a portable fan with a good air-blowing effect.

BACKGROUND

In an existing design of a portable fan, a housing is usually designed into a grille form to enlarge a communication area between a fan blade and an external environment, so that the fan blade can better draw in and supply air while reducing wind resistance.

However, the grille design also exposes the fan blade. This can easily cause an unsafe situation such as hairs getting tangled. Therefore, it is urgent to design a portable fan that is safe and that has a good air-blowing effect.

SUMMARY

In view of this, the present disclosure provides a portable fan, including a housing, a substrate, and a fan assembly. The substrate is arranged on a radial inner side of the housing. The fan assembly is connected to a rear side of the substrate and is accommodated inside the housing. A maximum diameter of the substrate is greater than or equal to a maximum diameter of the fan assembly.

Compared with the prior art, the portable fan of the present disclosure has the following beneficial effects: By the arrangement of the substrate to block the fan assembly, the fan assembly is hidden to improve safety. The substrate with a large diameter can expand a larger air blowing surface. Meanwhile, the front side of the substrate is a cambered surface and protrudes forwards out of the front end of the housing, so that an air flow blown out of the air outlet can better intensively flow forwards, and an air blowing effect is good.

DETAILED DESCRIPTION OF THE EMBODIMENTS

Figure 1:
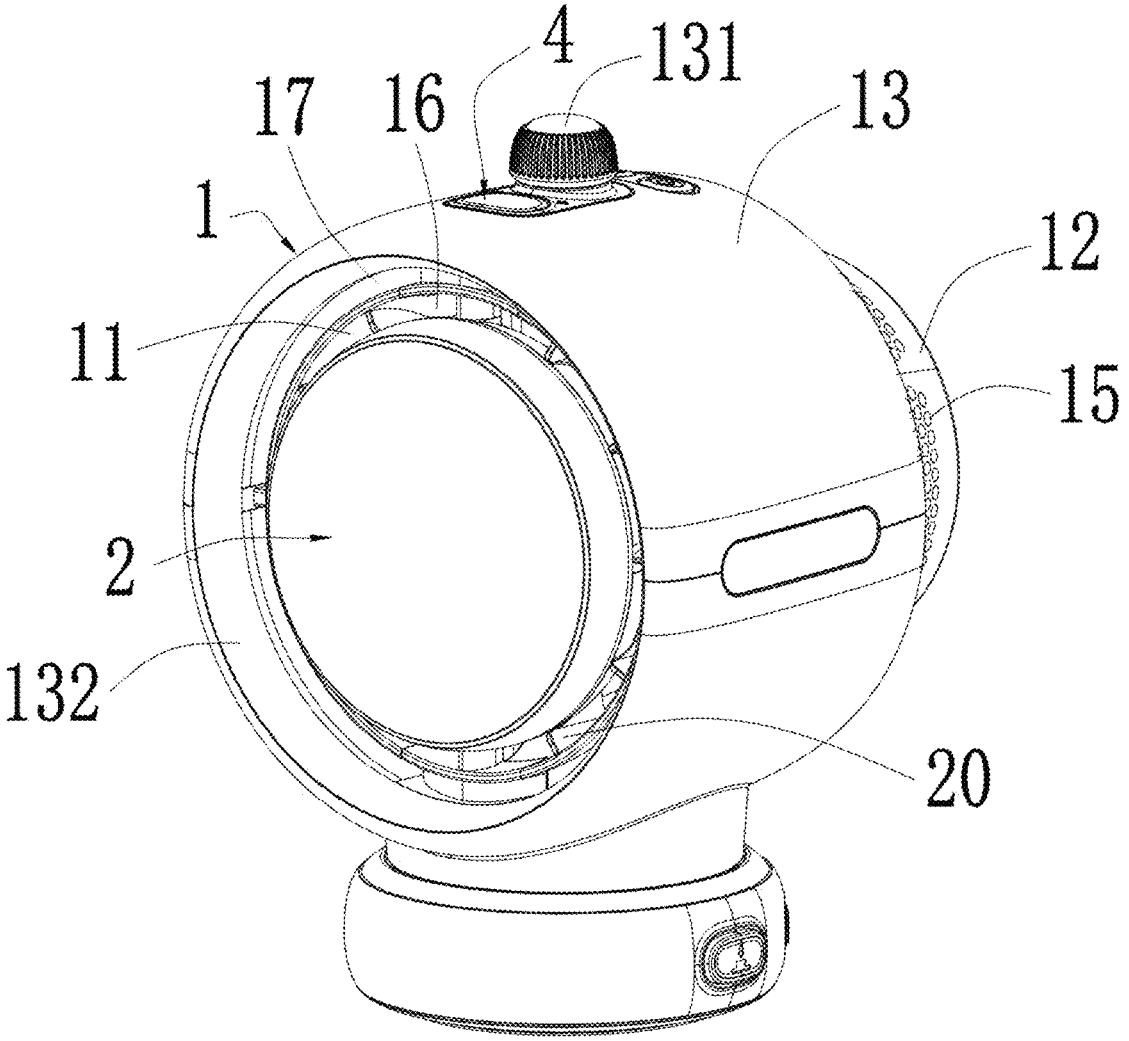
FIG. 1 is a three-dimensional diagram of a portable fan according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

The terms "top", "bottom", and other indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Figure 2:
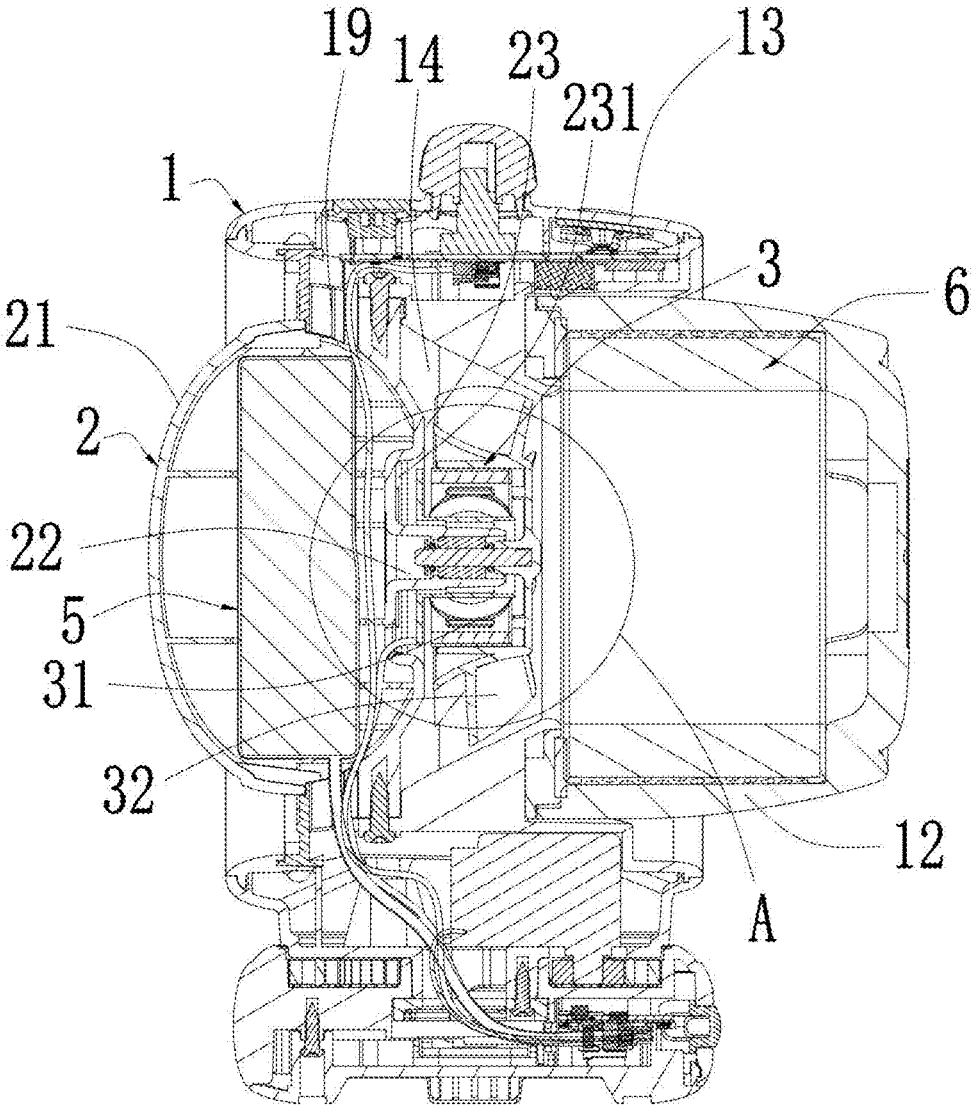
FIG. 2 is a cross-sectional view of a portable fan according to an embodiment of the present disclosure.

In an embodiment, as shown in FIG. 1 and FIG. 2, a schematic diagram of a portable fan of the present disclosure is shown. The portable fan includes a housing 1, a substrate 2, and a fan assembly 3. The housing 1 includes an accommodating cavity 14. The housing 1 is further formed with an air inlet 15 communicated to the accommodating cavity 14. At least a portion of the substrate 2 is arranged on a radial inner side of the housing 1, and an air outlet 16 is formed between the substrate 2 and the housing 1. The fan assembly 3 is arranged inside the accommodating cavity 14 and is connected to a rear side of the substrate 2. The fan assembly 3 includes a motor 31 and a fan blade 32. The motor 31 is a high-speed motor.

It should be noted that the high-speed motor is not limited to a high speed, but it can both reach a relatively high speed and cover a low speed range. For example, a speed range of the motor 31 can be 2000 to 6000 RPM/MIN, 6000 to 15000 RPM/MIN, 15000 to 41000 RPM/MIN, or 20000 to 80000 RPM/MIN. Speeds within different ranges correspond to different wind speed gears, and adjustment on the wind speed gears can be stepless, so as to more accurately control a desired air blowing effect. In addition, the motor 31 can be a three-phase motor or a single-phase motor. It is preferably a three-phase motor.

In an embodiment, as shown in FIG. 1 and FIG. 2, a maximum diameter of the substrate 2 is greater than or equal to a maximum diameter of the fan assembly 3. That is, the substrate 2 blocks a front side of the fan assembly 3, and the fan assembly 3 is hidden behind the substrate 2. A person skilled in the art usually calls a fan with a hidden fan assembly 3 as a bladeless fan, so that the portable fan with the bladeless design is safer. The substrate 2 with a large diameter can expand a larger air blowing surface. Meanwhile, a front side of the substrate 2 includes a protrusion 21.

The protrusion 21 protrudes forwards out of a front end of the housing 1, so that an air flow blown out of the air outlet 16 can better intensively flow forwards, and an air blowing effect is good. In addition, the protrusion 21 can also guide the air flow, thereby reducing turbulence and lowering noise. In this embodiment, the maximum diameter of the substrate 2 is greater than the maximum diameter of the fan assembly 3. It is beneficial for improving wind energy.

In this embodiment, the entire protrusion 21 is a cambered surface which can guide the air flow to flow tightly against the cambered surface, thereby better reducing turbulence and lowering noise. Certainly, in other embodiments, the protrusion 21 may be in a shape with a cambered surface on an outer periphery and a concave cavity in a center, or the protrusion 21 may be in a shape with a groove in an outer periphery and a protruding center. They are not limited by the examples.

Figure 3:
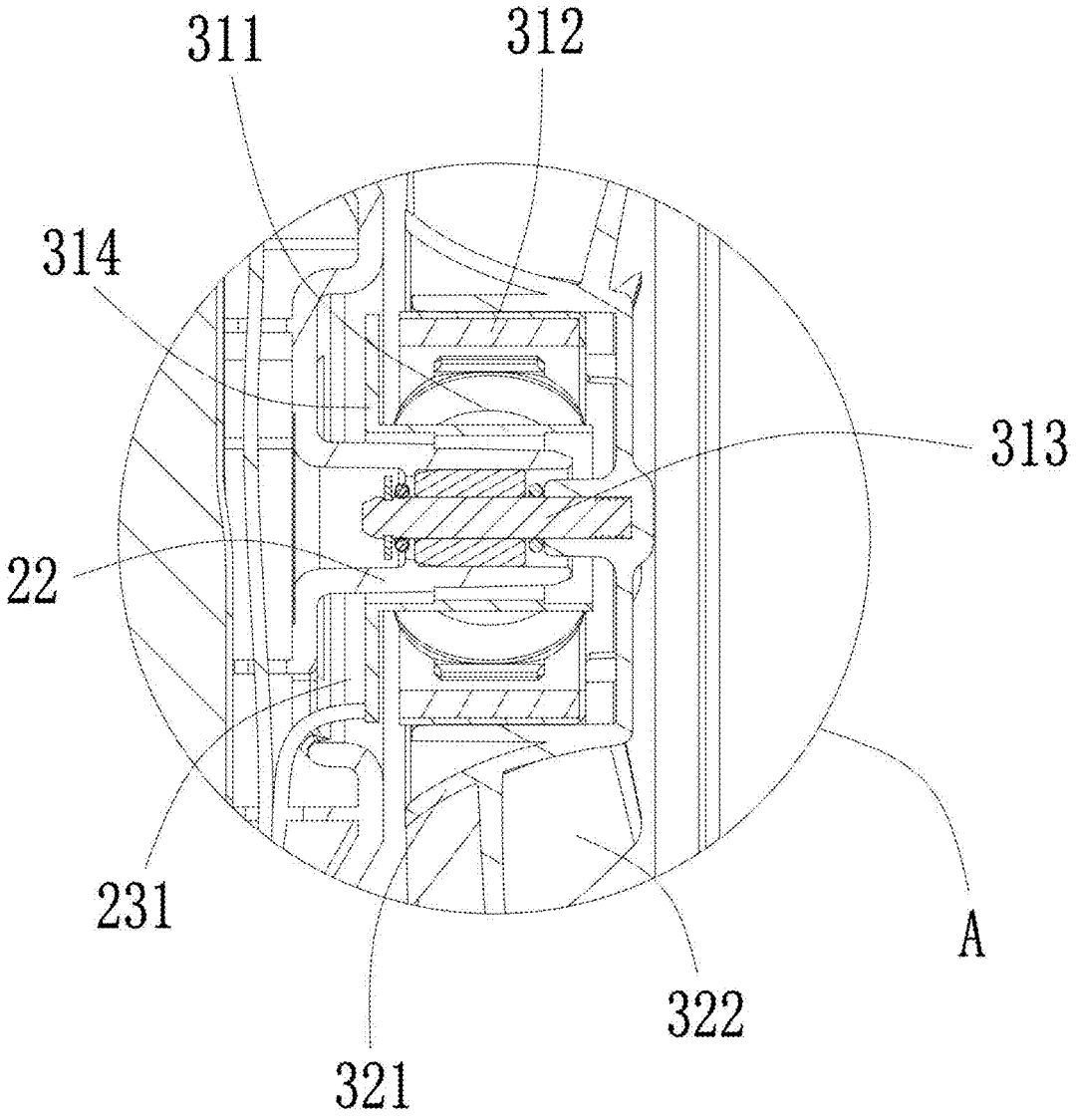
FIG. 3 is an enlarged view of part A in FIG. 2.

In an embodiment, as shown in FIG. 2 and FIG. 3, the motor 31 is an external rotor motor. A stator 311 of the external rotor motor is closer to a rotating shaft 313 in a radial direction relative to a rotor 312. The rotor 312 is directly or indirectly fixed to the fan blade 32, so that when the stator 311 is powered on to generate a magnetic field, to simultaneously drive the rotor 312 and the fan blade 32 to rotate. The structure of the external rotor motor 31 is more reasonable and can reduce an occupied volume in the portable fan. The fan blade 32 is a fan type between a centrifugal fan and an axial fan, which can better balance a relationship between a wind pressure and an air volume. The fan blade 32 includes a hub 321 and a plurality of blades 322. The plurality of blades 322 are spaced apart and connected to an outer side of the hub 321 in a surrounding manner, and at least a portion of the hub 321 is radially enlarged from back to front. The radially enlarged hub 321 increases the wind pressure and can also enlarge an air supply area.

In an embodiment, as shown in FIG. 1 to FIG. 3, a plurality of guide blades 20 are further arranged between the outer shell 1 and the substrate 2, and the plurality of guide blades 20 are connected to the housing 1 and the substrate 2. It should be understood that the plurality of guide blades 20 can be integrally formed with the substrate 2, or integrally formed with the housing 1, or separately formed, or integrally formed with the housing 1 and the substrate 2, without limitation. A shaft tube 22 is formed on a rear side of the substrate 2. The rotating shaft 313 of the motor 31 is fixedly connected to the fan blade 32 and is inserted into the shaft tube 22 from back to front. It should be understood that the shaft tube 22 can be integrally formed from the substrate 2, or can be connected to the substrate 2 after being separately formed.

In an embodiment, as shown in FIG. 2 and FIG. 3, the substrate 2 includes a rear side plate 23. A surrounding portion of the rear side plate 23 corresponding to the shaft tube 22 is forwards formed into a recess 231. The stator 311 of the motor 31 is arranged on an outer side of the shaft tube 22. The rotor 312 of the motor 31 is arranged on a radial outer side of the stator 311, and a circuit board 314 of the motor 31 is arranged on front sides of the stator 311 and the rotor 312 of the motor 31. Therefore, in order to better use a space, the portion of the substrate 2 corresponding to the shaft tube 22 is forwards formed into the recess 231, to just provide a position for the circuit board 314 of the motor 31. Certainly, in other embodiments, the circuit board 314 can also be arranged inside the substrate 2 or another component of the portable fan. The substrate 2 accommodates a battery 5, and the battery 5 is electrically connected to the motor 31. Specifically, the battery 5 is electrically connected to the circuit board 314 of the motor 31. The circuit board 314 of the motor 31 is electrically connected to the stator 311 of the motor 31. After the stator 311 of the motor 31 is powered on to generate a magnetic field, to drive the rotor 312 of the motor 31 to rotate. The rotor 312 of the motor 31 drives the fan blade 32 to rotate synchronously, thereby generating wind.

Figure 4:
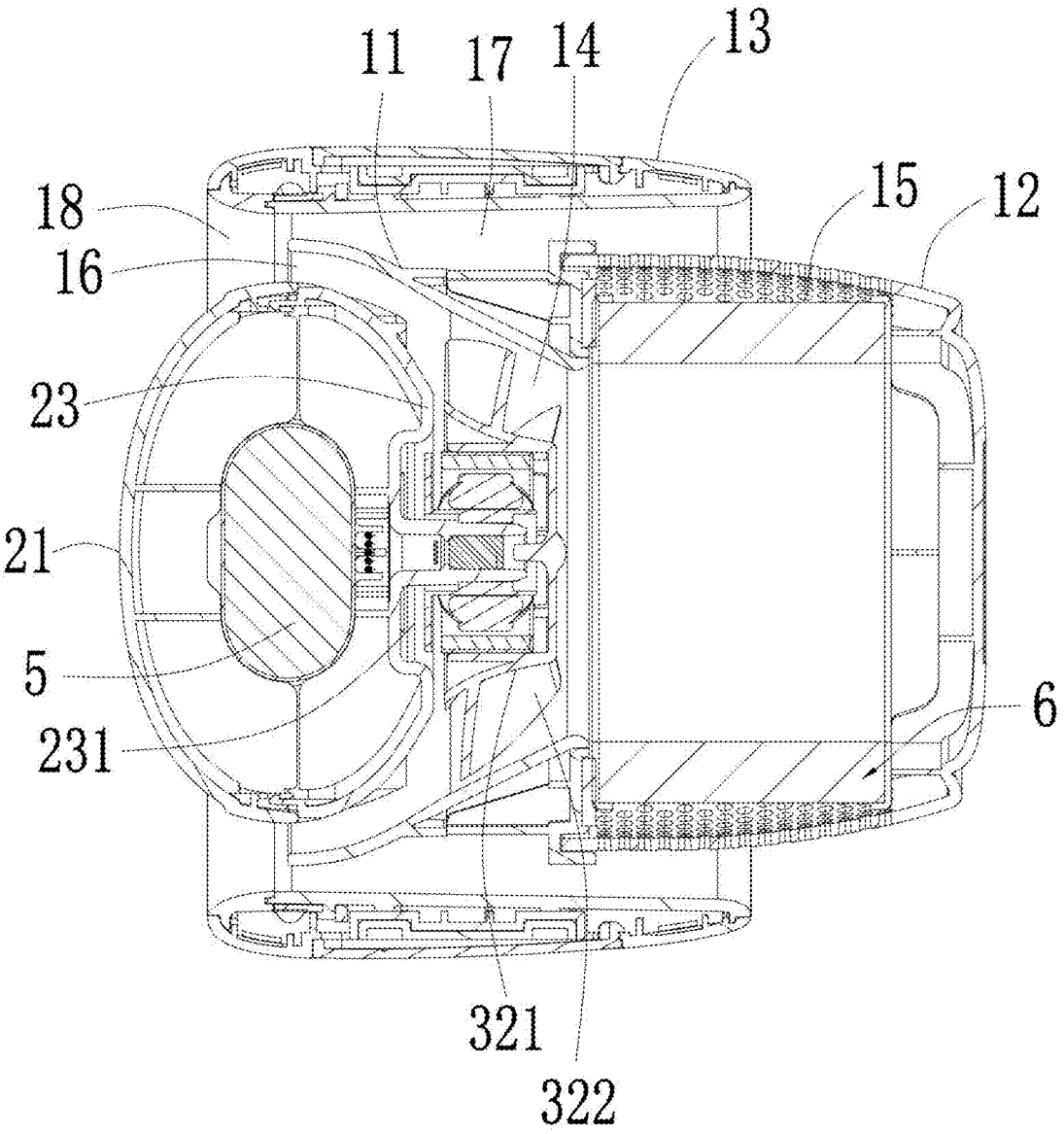
FIG. 4 is a cross-sectional view of a portable fan according to an embodiment of the present disclosure, viewed in another angle.

In an embodiment, as shown in FIG. 2 and FIG. 4, at least a portion of the substrate 2 is radially enlarged from an edge of the rear side plate 23 to the air outlet 16. That is, from the rear side plate 23 towards a front side, on a rear side of the air outlet 16, at least a portion of the substrate 2 is radially enlarged within this range, thereby increasing a wind pressure and improving wind energy. From the air outlet 16 towards a front side, at least a portion of the substrate 2 is radially narrowed to guide the air flow to be converged, with a trend for concentrated air blowing.

In an embodiment, as shown in FIG. 2 to FIG. 4, the fan blade 32 includes a hub 321 and a plurality of blades 322. The plurality of blades 322 are spaced apart and connected to an outer side of the hub 321 in a surrounding manner, and at least a portion of the hub 321 is radially enlarged from back to front. It should be understood that the fan blade 32 can be a diagonal flow fan or a mixed flow fan. In addition to axial air blowing of an axial flow fan, the fan blade 32 of the present disclosure also has diagonal air blowing. Moreover, the hub 321 that is radially enlarged from back to front has a function of increasing a wind pressure and improving wind efficiency.

In an embodiment, as shown in FIG. 1, FIG. 2, and FIG. 4, the housing 1 includes a first shell 11, a second shell 12, and a third shell 13. The second shell 12 is connected to the first shell 11, one behind another, and a plurality of the air inlets 15 are formed in the second shell 12. In this embodiment, the fan assembly 3 is arranged on an inner side of the first shell 11, and the plurality of air inlets 15 are annularly arranged on a radial side wall of the second shell 12. The plurality of air inlets 15 that are annularly arranged on the radial side wall of the second shell 12, so that an air blowing area can be enlarged, and more air intake channels are added. Moreover, the fan assembly 3 is arranged on an inner side of the first shell 11, thus forming an air inlet cavity on an inner side of the second shell 12, thereby making a large air inlet space to ensure sufficient air input. In this embodiment, the air inlets 15 are only annularly arranged on the side wall of the second shell 12. In other embodiments, the air inlets 15 can also be arranged on a rear wall of the second wall shell 12. In this embodiment, a filter element 6 is further arranged on the radial inner side of the second shell 12, so that impurities of air can be filtered at an air inlet end, making the blown air flow fresher and healthier. Moreover, there is a space on the radial inner side of the second shell 12 to arrange the filter element 6. In addition, the filter element 6 can directly correspond to radial inner sides of the plurality of air inlets 15, so that a space setting is proper.

In an embodiment, as shown in FIG. 2 and FIG. 4, an inner side wall of the first shell 11 has an enlargement trend from back to front. a radial inner side of the first shell 11 accommodates the fan assembly 3. At least a portion of the hub 321 of the fan blade 32 is radially enlarged from back to front, that is, each of the hub 321 and the inner side wall of the first shell 11 has a portion that is radially enlarged from back to front. The inner side wall of the first shell 11 also has a function of increasing a wind pressure. Due to the two pressure increasing effects, the wind energy is further improved, and air can be blown farther.

In an embodiment, as shown in FIG. 1, FIG. 2, and FIG. 4, the third shell 13 is arranged on radial outer sides of the first shell 11 and the second shell 12. An induced draft channel 17 is formed between the radial outer sides of the first shell 11 and the second shell 12 and a radial inner side of the third shell 13. In this embodiment, the third shell 13 is annularly arranged on the radial outer sides of the first shell 11 and the second shell 12, and the induced draft channel 17 is also annularly arranged on the radial outer sides of the first shell 11 and the second shell 12. Certainly, in other embodiments, the third shell 13 may also be only arranged at ⅔, ½, ⅓, or ¼ of the radial outer sides of the first shell 11 and the second shell 12, that is, the third shell 13 may not be completely annularly arranged on the radial outer sides of the first shell 11 and the second shell 12. A proportion of the third shell 13 that is arranged on the radial outer sides of the first shell 11 and the second shell 12 will not be limited by the example. It should be understood that due to the arrangement of the induced draft channel 17 is based on the Bernoulli's principle. A fluid velocity close to the air outlet 16 is high, and a pressure is low, thus forming a negative pressure region, which drives air in the induced draft channel 17 to flow. Therefore, an air volume is doubled, and a blowing effect is greatly enhanced.

In an embodiment, as shown in FIG. 1, FIG. 2, and FIG. 4, the cambered surface on the front side of the substrate 2 protrudes forwards out of the front end of the housing 1, and an air convergence channel 18 is formed between the third shell 13 and the substrate 2. The air convergence channel 18 gathers an air flow of the induced draft channel 17 and an air flow blown out from the air outlet 16. According to the Coanda effect, also known as a wall attachment effect, it means that a fluid deviates from its original flowing direction, but flows along a surface of a protruding object. Therefore, in the air convergence channel 18, both the air flow of the induced draft channel 17 and the air flow blown out from the air outlet 16 tend to flow with the protrusion 21, thereby reducing turbulence, lowering noise, and optimizing an air blowing effect.

In an embodiment, as shown in FIG. 1, FIG. 2, and FIG. 4, the third shell 13 is provided with a lighting part 132 facing the air convergence channel 18. In this embodiment, a surface of the lighting part 132 is a cambered surface, and the lighting part 132 is slantways outward in a radial direction. The lighting part 132 plays a role in guiding the air flow, and provides non direct light to the front, making a user experience better. The lighting part 132 can be arranged in a surrounding manner, spaced apart, or locally arranged.

In an embodiment, as shown in FIG. 1 and FIG. 2, the portable fan further includes a connector 19. The connector 19 is simultaneously connected to the third shell 13, the first shell 11, and the substrate 2. The third shell 13 is provided with a switch 131. A wire passes through the connector 19 to electrically connect the battery 5 with the switch 131. In this embodiment, the third shell 13 is further provided with a display element 4, and the display element 4 displays working information such as a wind speed, a battery level, and a working mode to the outside through the third shell 13. The switch 131 and the display element 4 are simultaneously arranged inside the third shell 13. Real-time adjustment can be performed according to content of the display element 4, to achieve a desired working mode.

Certainly, in other embodiments, the display element 4 can also be arranged inside the substrate 2, and the display element 4 can display working information such as a wind speed, a battery level, and a working mode to the outside through the substrate 2. Due to the arrangement of the connector 19, the switch 131 can also be electrically connected to the display element 4 located inside the substrate 2. Arranging the display element 4 inside the substrate 2 can also enhance the technological sense of human-computer interactions.

Figure 5:
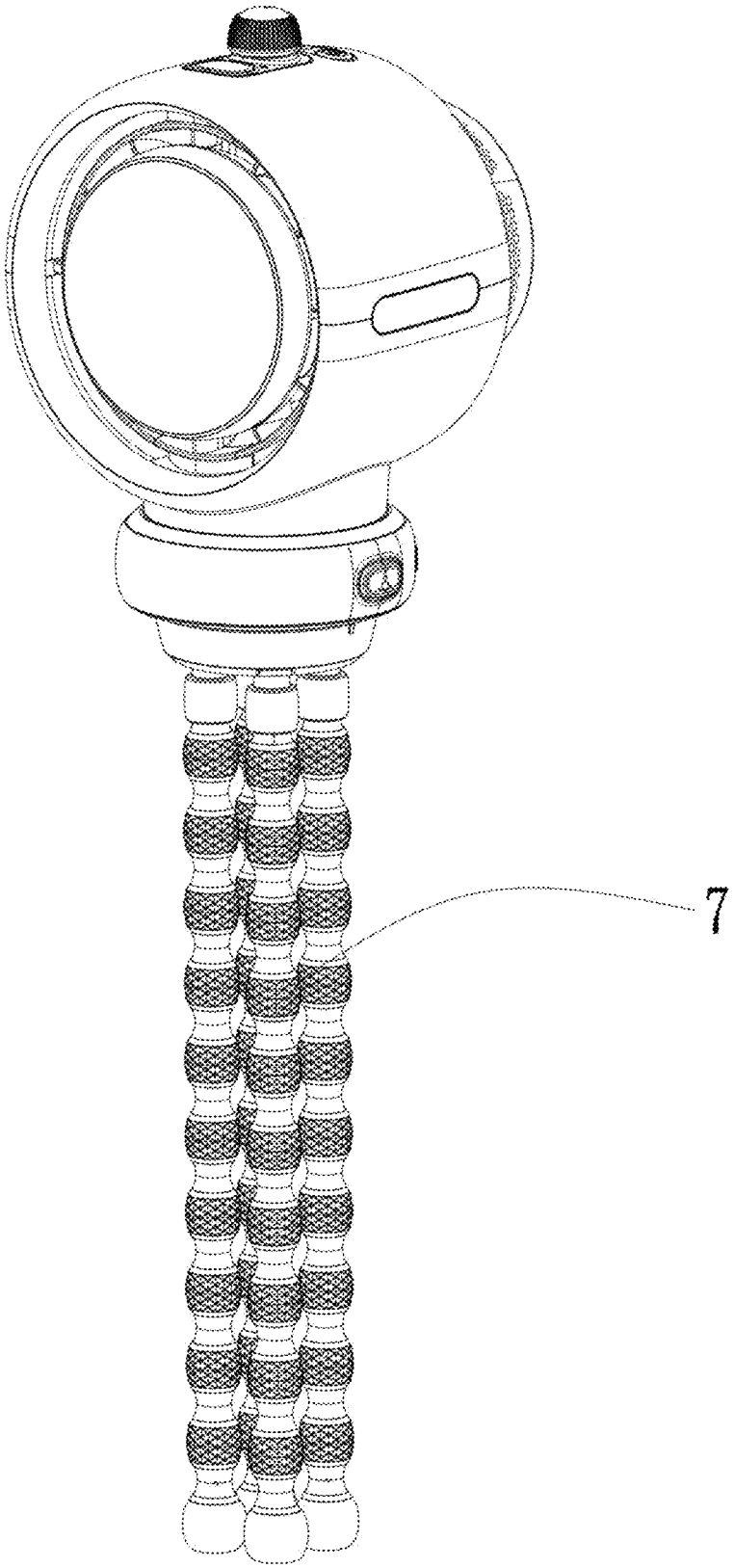
FIG. 5 is a three-dimensional diagram of a portable fan according to another embodiment of the present disclosure.

It should be understood that the portable fan of the present disclosure can be a desktop fan, a handheld fan, a clip fan, an octopus-shaped fan, or another form. As shown in FIG. 5, the portable fan may further include an octopus-shaped base 7. An upper fan body and the lower octopus-shaped base 7 are rotatable each other, so that the upper fan body can shake its head to blow air. Furthermore, the lower octopus-shaped base 7 can fix the portable fan to a handrail of a vehicle, a branch, and other places, thereby enriching application scenarios of the portable fan. Certainly, the base can also use other forms and is not limited by the example.

One or more implementation modes are provided above in combination with specific contents, and it is not deemed that the specific implementation of the present invention is limited to these specifications. Any technical deductions or replacements approximate or similar to the method and structure of the present invention or made under the concept of the present invention shall fall within the scope of protection of the present invention.

What is claimed is:

1. A portable fan, comprising:

a housing, comprising an accommodating cavity, wherein the housing is further formed with an air inlet communicated to the accommodating cavity;

a substrate, wherein at least a portion of the substrate is arranged on a radial inner side of the housing; and a fan assembly, arranged inside the accommodating cavity and connected to a rear side of the substrate, wherein the fan assembly comprises a motor and a fan blade;

wherein an air outlet is formed between a periphery of a maximum diameter of the substrate and the housing, and the maximum diameter of the substrate is greater than or equal to a maximum diameter of the fan assembly; a front side of the substrate comprises a protrusion; the protrusion protrudes forwards out of a front end of the housing and air flow blown out of the air outlet is guided by the maximum diameter of the substrate, thereby expanding a larger air blowing surface; and wherein a shaft tube is formed on the rear side of the substrate; a stator of the motor is arranged on an outer side of the shaft tube, a rotor of the motor is directly or indirectly fixed to the fan blade; and a rotating shaft of the motor is inserted into the shaft tube from back to front.

2. The portable fan according to claim 1, wherein a display element is arranged inside the substrate, and the display element is configured for displaying working information including one or more of a wind speed, a battery level, and a working mode to an outside through the substrate.

3. The portable fan according to claim 1, wherein the fan blade is a diagonal flow fan or a mixed flow fan.

4. The portable fan according to claim 1, wherein the housing comprises a first shell, a second shell, and a third shell; the second shell is connected to the first shell, one behind another; wherein the air inlet is a plurality of air inlets which are formed in the second shell; and the third shell is arranged on radial outer sides of the first shell and the second shell.

5. The portable fan according to claim 4, wherein the air outlet is formed between the periphery of the maximum diameter of the substrate and the third shell.

6. The portable fan according to claim 4, wherein an inner side wall of the first shell has an enlargement trend from back to front.

7. The portable fan according to claim 4, wherein the third shell is further provided with a display element, and the display element displays working information including a wind speed, a battery level, and a working mode to an outside through the third shell.

8. The portable fan according to claim 4, wherein an induced draft channel is formed between the radial outer sides of the first shell and the second shell and a radial inner side of the third shell.

9. The portable fan according to claim 8, wherein an air convergence channel is formed between the third shell and the substrate, and the air convergence channel gathers an air flow of the induced draft channel and the air flow blown out from the air outlet.

10. The portable fan according to claim 9, wherein the third shell is provided with a lighting part facing the air convergence channel, wherein a surface of the lighting part is a cambered surface.

11. The portable fan according to claim 10, wherein the lighting part is slantways outward in a radial direction.

12. The portable fan according to claim 1, wherein the motor is a high-speed motor, and a speed range of the motor is 2000 to 6000 RPM/MIN, 6000 to 15000 RPM/MIN, 15000 to 41000 RPM/MIN, or 20000 to 80000 RPM/MIN.

13. The portable fan according to claim 1, wherein the motor is a three-phase motor.

14. A portable fan, comprising:

a housing, comprising an accommodating cavity, wherein the housing is further formed with an air inlet communicated to the accommodating cavity;

a substrate, wherein at least a portion of the substrate is arranged on a radial inner side of the housing; and a fan assembly, arranged inside the accommodating cavity and connected to a rear side of the substrate, wherein the fan assembly comprises a motor and a fan blade;

wherein an air outlet is formed between a periphery of a maximum diameter of the substrate and the housing, a display element is arranged inside the substrate, and the display element is configured for displaying working information including one or more of a wind speed, a battery level, and a working mode to an outside through the substrate; and a shaft tube is formed on the rear side of the substrate; a stator of the motor is arranged on an outer side of the shaft tube, a rotor of the motor is directly or indirectly fixed to the fan blade; and a rotating shaft of the motor is inserted into the shaft tube from back to front.

15. The portable fan according to claim 14, wherein the portable fan is a handheld fan.

16. The portable fan according to claim 14, wherein the fan blade is a diagonal flow fan or a mixed flow fan.

17. The portable fan according to claim 14, wherein a front side of the substrate comprises a protrusion; and the protrusion protrudes forwards out of a front end of the housing.

18. The portable fan according to claim 14, wherein the substrate comprises a rear side plate; a surrounding portion of the rear side plate corresponding to the shaft tube is forwards formed into a recess; and the recess provides a position for a circuit board of the motor.

* * * * *